US006241029B1

(12) United States Patent
Coenen et al.

(10) Patent No.: US 6,241,029 B1
(45) Date of Patent: Jun. 5, 2001

(54) EARTH FORMATION SURVEYING DEVICE

(75) Inventors: Josef Guillaume Christoffel Coenen; Barend Jan Pestman, both of Rijswijk (NL)

(73) Assignee: Shell Research Limited, London (GB)

( * ) Notice: Subject to any disclaimer, the term of this patent is extended or adjusted under 35 U.S.C. 154(b) by 0 days.

(21) Appl. No.: 09/403,973

(22) PCT Filed: Jun. 17, 1998

(86) PCT No.: PCT/EP98/03999

§ 371 Date: Oct. 28, 1999

§ 102(e) Date: Oct. 28, 1999

(87) PCT Pub. No.: WO98/59146

PCT Pub. Date: Dec. 30, 1998

(30) Foreign Application Priority Data

Jun. 20, 1997 (EP) ..... 97201894

(51) Int. Cl.[7] ..... E21B 7/00

(52) U.S. Cl. ..... 175/44; 73/864.43

(58) Field of Search ..... 73/864.43; 175/58, 175/40, 44, 21, 67, 323; 166/308, 222, 223

(56) References Cited

U.S. PATENT DOCUMENTS

| | | | | |
|---|---|---|---|---|
| 3,584,293 | * | 6/1971 | Iizuka | 324/6 |
| 3,857,289 | * | 12/1974 | Wise et al. | 73/864.43 |
| 4,345,650 | * | 8/1982 | Wesley | 166/249 |
| 5,377,761 | * | 1/1995 | Kosar et al. | 166/208 |

* cited by examiner

*Primary Examiner*—Robert E. Pezzuto

(57) ABSTRACT

A survey device for use in a borehole formed in an earth formation. The device includes a carrier body carrying earth formation survey apparatus and drilling device arranged at the front end of the device for drilling of the borehole, a device for progressing the carrier body through the borehole in correspondence with progress of drilling by the drilling device and a device for removing the rock particles resulting from the drilling process. The device for removing the rock particles comprises a device for transporting the rock particles to the rear end of the device and depositing the rock particles into the borehole behind the rear end of the device.

10 Claims, 1 Drawing Sheet

EARTH FORMATION SURVEYING DEVICE

FIELD OF THE INVENTION

Background of the Invention

The present invention relates to a device for surveying an earth formation. Non-intrusive methods such as seismic surveying are generally applied to identify potential hydrocarbon containing zones in the earth formation. In applying such seismic methods shock waves are generated at the earth surface and the reflections from the various earth layers are detected to provide data on the structure of the various layers. Seismic technology however is limited with respect to spatial and contrast resolution and often seismic surveying is to be supplemented by scouting exploration drilling, while subsequent appraisal drilling is to provide verification for better defined estimates of the volumes of hydrocarbon fluid in place and the recoverable reserves.

In exploration drilling one or more survey tools are lowered into a borehole drilled in the earth formation to provide data on characteristics of the formation. During drilling, drill cuttings (that is the rock particles that are spalled off during drilling) are transported upwardly to surface in a stream of drilling fluid flowing in the annular space between the drill string and the borehole wall. To prevent collapse of the borehole, the borehole is provided with a casing.

Such conventional survey methods are expensive in view of the requirement for casing to be set in the borehole to stabilize the borehole, whereby casing sections are installed in a nested arrangement, with an upper section of relatively large diameter and sections of stepwise decreasing diameter in downward direction.

It is an object of the invention to provide an improved device for surveying an earth formation through borehole formed in the formation, which device obviates the need for casing sections to be set in the borehole.

SUMMARY OF THE INVENTION

In accordance with the invention there is provided a survey device for use in a borehole formed in an earth formation, the device comprising a carrier body carrying earth formation survey means and drilling means arranged at the front end of the device for drilling of the borehole, means for progressing the carrier body through the borehole in correspondence with progress of drilling by the drilling means, and means for removing the rock particles resulting from the drilling process, wherein the means for removing the rock particles comprises means for transporting the rock particles to the rear end of the device and depositing rock particles into the borehole behind the rear end of the device.

By depositing drill cuttings in the borehole behind the device, it is no longer required to transport the cuttings to surface in a stream of drilling fluid. Therefore there is no need to maintain a drilling fluid passage in the borehole, and consequently there is no need to set casing in the borehole. Furthermore, the enormous amount of drill cuttings in the borehole reduces the permeability in the borehole to a sufficiently low level to prevent uncontrolled escape of hydrocarbon fluid to surface (blow-out).

The device according to the invention is intended to target oil or gas in an intelligent way, to provide evidence on the occurrence of oil and gas in prospect formations, and to carry out sophisticated measurements on the earth formation.

To further reduce pressure communication between different layers of the earth formation, and from any such layer to surface, the device suitably comprises means for injecting a borehole sealing compound into the borehole behind the device. Such sealing compound can be, for example, plastic foam or cement.

To obtain information on the position of the device in the formation and to steer the device along a selected route, the device is suitably provided with a gyroscope.

For the sake of completeness, reference is made to U.S. Pat. No. 3,857,289. This publication discloses a telescopic soil sampling device provided at its front end with a drill bit, which soil sampling device is connected with its back end to a drill string for rotating the drill bit.

BRIEF DESCRIPTION OF THE FIGURE

The FIGURE schematically shows a longitudinal side view of a device according to the invention.

The invention will be described hereinafter in more detail and by way of example, with reference to the accompanying FIGURE.

Figure 1:
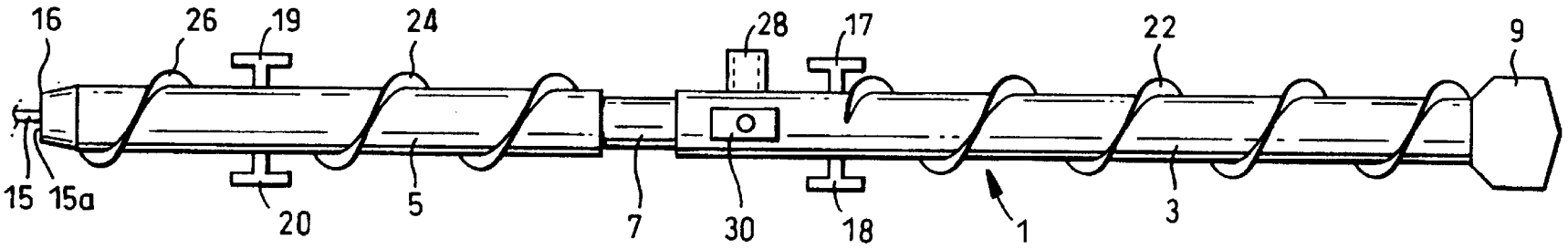

The device shown in the FIGURE has a carrier body 1 of substantially cylindrical shape. The carrier body 1 includes first and second members 3, 5 interconnected by a telescoping joint 7 which is adapted to move between a retracted position and an extended position, and which is capable of providing a thrust force between the two members 3, 5 when moved from the retracted to the extended position. The first member 3 is provided with a drill bit 9 located at the front end of the body 1 for drilling a borehole into an earth formation. The drill bit 9 is driven by an electric motor which in turn is powered by a rechargeable energy storage/supply system (not shown) inside the carrier body 1. Suitably, the rechargeable energy storage/supply system includes a flywheel driven by an electric motor (not shown) to store energy, which flywheel can drive an electric generator to supply electric energy. The rechargeable energy storage/supply system receives electric power via a cable incorporated in a multi-line wire 15 which is stored on a reel (not shown) inside the second member 5 and which extends through an opening 15*a* at the rear end 16 of the second member 5 and which is connected to an energy supply station (not shown) at a suitable location.

The first member 3 is provided with pads 17, 18 for selectively fixing the position of the first member 3 in the borehole, and the second member 5 is provided with pads 19, 20 for selectively fixing the position of the second member 5 in the borehole. Each pad 17, 18, 19, 20 is selectively movable between a radially retracted position and a radially extended positions, and is provided with a gripping profile (not shown) on its outer surface facing the borehole wall. The pads 17, 18, 19, 20 are driven by electric power supplied by way of the rechargeable energy storage/supply system.

The carrier body 1 is further provided with a helical screw conveyor in the form of auger screws 22, 24, 26 extending from the front end of the carrier body 1 to the rear end thereof. The auger screws 22, 24, 26 are driven in rotation relative the longitudinal axis of the carrier body 1 by electric power supplied by the rechargeable energy storage/supply system.

Survey of the earth formation is carried out by retrieving specimen core plugs from the formation by means of a hollow core drill 28 provided at the first member 3. The core drill 28 is radially extendible into the rock formation in which the borehole is drilled, to retrieve core plugs from the rock formation.

A fluid sampler 30 is arranged at the first member 3 to take samples of fluid flowing from the earth formation into the borehole. At selected borehole depths the effective flow properties on a local scale of the formation around the device are measured by determining the pressure response at the borehole wall upon retrieval of fluid from the formation and subsequent re-injection of the fluid into the formation.

Furthermore, the device is provided with analyzer means (not shown) for analyzing the core plugs and the fluid samples under the conditions prevailing in the formation, and with data transfer means to transfer the data resulting from the analysis and from pressure measurements to surface via a fibre-optic data transfer line incorporated in multi-line wire 15.

During normal operation of the device shown in the FIGURE., the device is induced to drill a borehole in the earth formation by rotation of the drill bit 9. Normal operation of the device is explained from the starting point that the device is present in a borehole portion already drilled, either using the device or using any other suitable drilling device. The telescoping joint 7 is in its retracted position. The rechargeable energy storage/supply system is provided with sufficient energy by way of the electric cable in multi-line wire 15 to rotate the flywheel at high speed. The pads 17, 18 are moved to their retracted position, and the pads 19, 20 are moved to their extended position so that their gripping profiles push firmly against the borehole wall to fix the position of the second member 5 in the borehole.

Drilling of a further borehole portion then proceeds by simultaneously transferring the energy of the rotating flywheel to the drill bit motor to rotate the drill bit 9, and gradually extending the telescoping joint 7 to its extended position. By extending the telescoping joint, the member 3 moves forward and provides a thrust force to the drill bit 9 which is thereby pushed against the bottom of the borehole and cuts into the rock formation to drill the further portion of the borehole. The reaction force resulting from the thrust force delivered by the telescoping joint is transferred by the pads 19, 20 to the borehole wall.

During drilling of the further borehole portion, the auger screws 22, 24, 26 are rotated to transport the drill cuttings to the rear end 16 of the carrier body 1 and to deposit the cuttings in the borehole behind the carrier body 1. The multi-line wire 15 remains static between the cuttings and will therefore not suffer from wear by friction.

To initiate drilling of yet a further borehole portion, the rechargeable energy storage/supply system is again provided with sufficient energy via the electric cable in multi-line wire 15 to rotate the flywheel at high speed. The pads 17, 18 are extended against the borehole wall to fix the position of the first member 3 in the borehole. Next, the pads 19, 20 are retracted and the telescoping joint 7 is retracted so that the second member 5 moves forward. Subsequently the pads 17, 18 are retracted and the pads 19, 20 are extended against the borehole wall in order to fix the position of the second member 5 in the borehole. Drilling of the further borehole portion then proceeds similarly to the manner described above with reference to the previous borehole portion.

As the borehole is deepened and the device moves forward in the borehole, the multi-line wire 15 is gradually unreeled from the reel located in the second member 5, so that the multi-line wire is extended in the borehole without requiring axial movement of the wire in the borehole.

In this manner the borehole is extended in incremental steps by the self propelled device.

The drill cuttings are deposited in the borehole behind the device, so that there is no need for the drill cuttings to be transported to surface. The multi-line wire 15 remains statically positioned in-between the drill cuttings.

An implication of this procedure is that there is no need to keep the borehole open, and therefore there is no need for casing to be set in the borehole. The drill cuttings in the borehole reduce the permeability in the borehole sufficiently to prevent leakage to surface of high pressure formation fluids that are encountered during drilling.

At selected depths samples of formation fluid entering the borehole are taken using the fluid sampler 30, and core plugs are taken using the core drill 28. The fluid samples and core plugs are analyzed by the analyzer means and the resulting data are transferred to surface by the data transfer means via the data transfer line in multi-line wire 15. Such data include, for example, porosity, absolute permeability, relative permeability, capillary pressure and hydrocarbon fluid storage capacity, e.g. the initial and residual oil saturation levels.

The device 1 can be launched at the earth surface to drill the entire borehole to the desired depth, or alternatively the device can be launched from a docking station located in a wellbore drilled earlier. The latter option can be preferred in view of the limited length of wire 15 which can be stored inside the carrier body 1, and in view of the power consumption of the device and the slow speed of drilling. The wire 15 should be used as efficiently as possible to deploy the device in a formation prospect which is considered to be of interest.

Furthermore, the device 1 can be further provided with various earth formation survey means. For example, the device can be provided with a strong acoustic source to generate acoustic signals in the earth formation, and one or more acoustic receivers (for example located at the rear-end of the device) can be provided in the device to receive acoustic reflections from the different earth formation layers, irregularities, high velocity areas, fluid traps, etc. Furthermore, the device can be provided with a temperature sensor and a formation fluid-pressure sensor.

By simultaneously operating two or more devices as described hereinbefore, acoustic interference measurements can be made between the devices which are either located in the same borehole or in different boreholes or borehole-branches. Thereby a detailed image of the sonic velocity distribution of the formation between the devices can be created (cross-well tomography). Also flow-interference testing between two (or more) devices or borehole-branches can be carried out by simultaneously injecting fluid from one device into the formation and withdrawing formation fluid from the other device. The pressure response on the borehole wall as measured by the two devices is a measure of the effective flow properties at a selected location in the formation.

What is claimed is:

1. A survey device for use in a borehole formed in an earth formation, the device comprising a carrier body carrying earth formation survey means and drilling means arranged at the front end of the device for drilling of the borehole, means for progressing the carrier body through the borehole in correspondence with progress of drilling by the drilling means, means for removing the rock particles resulting from the drilling process, wherein the means for removing the rock particles comprises means for transporting the rock particles to the rear end of the device and depositing rock particles into the borehole behind the rear end of the device and means for injecting a borehole sealing compound into the borehole behind the device.

2. The device of claim 1, wherein the means for removing the rock particles comprises a helical screw conveyor extending substantially from the drilling means to the rear end of the device.

3. The device of claim 2, wherein the helical screw conveyor extends around the carrier body.

4. The device of claim 1, further comprising energy transfer means including an energy transfer conduit which is progressively released from the carrier body into the borehole as the carrier body progresses through the borehole.

5. The device of claim 4, further comprising rechargeable energy storage means connected to the energy transfer means.

6. The device of claim 5, wherein the rechargeable energy storage means includes a flywheel capable of delivering energy to at least one of the drilling means and the means for progressing the carrier body through the borehole.

7. The device of claim 6, wherein the means for progressing the carrier body through the borehole comprises first and second members telescoping in longitudinal direction, means for selectively fixing the position of each of the first and second members in the borehole, and means for selectively inducing an inward or an outward telescoping movement of the first and second members.

8. The device of claim 7, wherein the means for selectively fixing the position of the first and second members in the borehole comprises a plurality of pads, each pad being radially extendible against the borehole wall, each member being provided with at least one of the pads.

9.The device of claim 8, wherein the earth formation survey means comprises a core sampling system to take core samples from the rock formation surrounding the borehole, means for analyzing the core samples to obtain data on the rock formation, and means for transmitting the data to surface.

10. The device of claim 9, wherein the earth formation survey means comprises means for analysing the rock particles resulting from the excavation process.

* * * * *